US005965836A

United States Patent [19]

Rakov

[11] Patent Number: 5,965,836

[45] Date of Patent: Oct. 12, 1999

[54] METHOD AND DEVICES FOR PROPULSION

[76] Inventor: Mikhail A. Rakov, 1028 Marcussen Dr., Menlo Park, Calif. 94025

[21] Appl. No.: 08/705,160

[22] Filed: Aug. 29, 1996

[51] Int. Cl.[6] ..... F41A 1/08; F42B 15/10

[52] U.S. Cl. ..... 89/1.7; 89/1.806; 89/1.816; 89/1.819; 102/374

[58] Field of Search ..... 102/372–374, 102/375, 437; 89/1.7, 1.701, 1.35, 1.819, 1.806, 1.812, 1.816; 124/57

[56] References Cited

U.S. PATENT DOCUMENTS

| | | | |
|---|---|---|---|
| 279,539 | 6/1883 | Chamberlain . | |
| 2,375,314 | 5/1945 | Mills | 124/11 |
| 2,588,184 | 3/1952 | Walsh | 46/74 |
| 3,102,525 | 9/1963 | Englis | 124/11 |
| 3,175,494 | 3/1965 | Turner | 102/38 |
| 3,369,609 | 2/1968 | Fogelgren | 169/31 |
| 3,417,719 | 12/1968 | Nitenson | 114/20 |
| 3,951,037 | 4/1976 | Bornand | 102/373 |
| 4,244,293 | 1/1981 | Grosswendt et al. | 102/374 |
| 4,328,632 | 5/1982 | Beers | 42/1 |
| 4,776,255 | 10/1988 | Smith | 89/1.13 |
| 4,843,750 | 7/1989 | Blase | 42/95 |
| 5,099,764 | 3/1992 | Dale et al. | 102/374 |
| 5,129,325 | 7/1992 | Matzagg | 102/372 |
| 5,668,341 | 9/1997 | Reynolds et al. | 89/1.35 |

FOREIGN PATENT DOCUMENTS

| | | | |
|---|---|---|---|
| 2034994 | 1/1972 | Germany . | |
| 496792 | 12/1938 | United Kingdom | 102/373 |

*Primary Examiner*—Harold J. Tudor
*Attorney, Agent, or Firm*—Leo F. Costello

[57] ABSTRACT

A method provides for shooting a missile-rocket. The missile-rocket has two movable parts and a propellant. The propellant is disposed between the one movable part and the first end of the other movable part. The missile-rocket undergoes three phases of acceleration. During the first phase, the method includes the steps of activating the propellant, moving one of the movable parts in response to the activation of the propellant, and urging the one of the movable parts to engage the other one of the movable parts. During the second phase, the method includes the step of urging the other one of the movable parts in response to the engagement. During the third phase, the method includes the step of releasing gases formed by activating the propellant from the missile-rocket to further urge the missile-rocket. The movable parts are preferably a shell and a core. In one embodiment, the core is moved in response to the activation of the propellant and urged to engage the front end of the shell. The shell is urged in response to the core engaging the front end of the shell. Further urging of the core and the shell is by releasing gases formed by activating the propellant from a chamber formed by the core and the shell. In another embodiment, the shell is moved in response to the activation of the propellant and urged to engage the core. The core is urged in response to this engagement. Further urging of the core and the shell is again by releasing gases formed by activating the propellant from a chamber formed by the core and the shell.

31 Claims, 9 Drawing Sheets

308
307
306
303
309
302
304
301
311
I 308
307
312
302
303
309
311
II
301

307
312
302
304
304
303
308
309
311
III
301

600
606
607
603
609
602
601
610
I 600
607
606
601
602
603
610
609
601
II 606
607
602
603
609
600
610
601
III

METHOD AND DEVICES FOR PROPULSION

FIELD OF THE INVENTION

This invention relates to accelerating material objects using the energy of chemical reactions or other sources of energy. These fields of technics can be summarily described as "shooting".

BACKGROUND OF THE INVENTION

Presently two main methods of shooting and two groups of devices for implementing these methods are used. In the first method, a material object, such as a missile or bullet, is accelerated using a special launching device, such as a barrel. The missile is accelerated by the pressure of gases in the barrel pushing the rear portion of the missile. The barrel can also produce rotation of the missile for its axial stabilization. The main advantage of this method is that it produces very high accelerations. However, such a method requires a complex and heavy launching device and wastes energy and material, such as the case of the cartridge. The launching device has complex kinematics because of the process of extracting this case, and the effects of recoil and of sharp report.

The second method uses the reactive principle. A rocket uses such a method. Here, forward and rotating motion are achieved by the energy of gases, outflowing from the shell. This method uses a simpler launching device and lacks the recoil and report effects. However, with this method, high accelerations are difficult to achieve.

It is desirable to have a shooting system that increases the use of energy and material, simplifies the launching device, and reduces the recoil and report.

SUMMARY OF THE INVENTION

In the present invention, a method is provided for shooting a missile-rocket. The missile-rocket functions as a projectile and thus may also be referred to as a projectile. The missile-rocket has two movable parts and a propellant. One movable part is mounted to a first end of a bore in the other movable part and is movable with respect to the other movable part to a second end of the other movable part. The propellant is disposed between the one movable part and the first end of the other movable part. The missile-rocket undergoes three phases of acceleration. During the first phase, the method includes the steps of activating the propellant, moving one of the movable parts in response to the activation of the propellant, and urging said moved one of the movable parts to engage the other one of the movable parts. During the second phase, the method includes the step of moving the other one of the movable parts in response to the engagement. During the third phase, the method includes the step of controllably releasing gases formed by activating the propellant from a chamber formed by the movable parts through openings to further urge the missile-rocket.

In the missile-rocket, the movable parts are a shell and a core.

In one embodiment, the core is moved in response to the activation of the propellant and urged to engage the front end of the shell. The shell then is urged in response to the core engaging the front end of the shell. Further urging of the projectile is by releasing gases formed by activating the propellant from a chamber formed by the core and the shell.

In another embodiment, the shell is moved in response to the activation of the propellant and then urged to engage the rear end of the core. The core then is urged in response to the shell engaging the rear end of the core. Further urging of the projectile is again by releasing gases formed by activating the propellant from a chamber formed by the core and the shell.

The present invention also provides devices, projectiles, or missile-rockets.

In one embodiment, the missile-rocket comprises a shell having a tubular shape of substantially uniform cross section over a first length and having a wall. The shell has openings therein for selectively releasing a gas from the shell to further urge the missile-rocket. A propellant is mounted to a rear portion of an inner surface of the wall of the shell for providing the gas. A massive core is mounted to a rear end of the shell and is movable within the shell to a front end of the shell in response to the gas and to urge the shell when the core engages the front end of the shell.

In another embodiment of a missile-rocket, a massive shell has a tubular shape of substantially uniform cross section over a first length and has a wall. The shell has openings therein for selectively releasing a gas from the shell. A propellant is disposed on a front portion of an inner surface of the wall of the shell for providing the gas. A core is disposed on the front end of the shell. The shell is movable with respect to the core. The gas urges the shell forward to engage the rear end of the shell to the core and to further urge the shell and the core forward when the rear end of the shell engages the core.

The missile-rocket may include a support disposed within the shell and having a first end coupled to the core and having a second end for engaging an external support.

These missile-rockets may be mountable into a launcher which provides support and direction to the missile-rocket.

A multi-stage missile-rocket comprises a shell that includes inner and outer shell sections. Each shell section has a tubular shape of substantially uniform cross section over a first length. The outer shell section has an engaging surface on a rear portion thereof. The inner shell section is movably disposed within the outer shell, has an engaging surface disposed on the rear end of the inner shell section for engaging the engaging surface of the outer shell section, and has openings for selectively releasing a gas from the shell. A propellant is disposed on a front portion of the outer shell section for providing the gas to urge the outer shell section forward to engage the engaging surface of the outer shell section to the engaging surface of the inner shell section and to further urge the shell forward after such engagement.

A missile-rocket comprises a shell having a wall. The wall has a gofferred shape in a first state and has a tubular shape of substantially uniform cross section over a first length in a second state. The core is mounted on the front end of the shell and is integral with the shell. The shell has openings for selectively releasing a gas from the shell. A propellant is disposed on to a front portion of an inner surface of the wall of the shell for providing the gas to urge the core from the first state to the second state and to further urge the shell forward in response to the releasing of the gas. The propellant may be, for example, an explosive or a compressible gas.

A missile-rocket comprises a core for storing a compressible fluid in a compressed state and having a valve mounted in a rear end of the core. A shell includes a semi-rigid portion and a flexible portion. The shell has an opening on a front end. The flexible portion has a first end mounted to a front end of the semi-rigid portion and has a second end integrally connected to the core near an end adjacent the valve. The flexible portion is capable of being inserted into the semi-rigid portion to position the valve of the core near the rear end for opening the valve of the core to release said fluid into a chamber formed by the core and the shell to urge the core forward as the fluid is released. The shell has openings for releasing the gas to further urge the core and the shell when the flexible portion is urged out of the semi-rigid portion.

DETAILED DESCRIPTION OF THE PREFERRED EMBODIMENT

Figure 1:
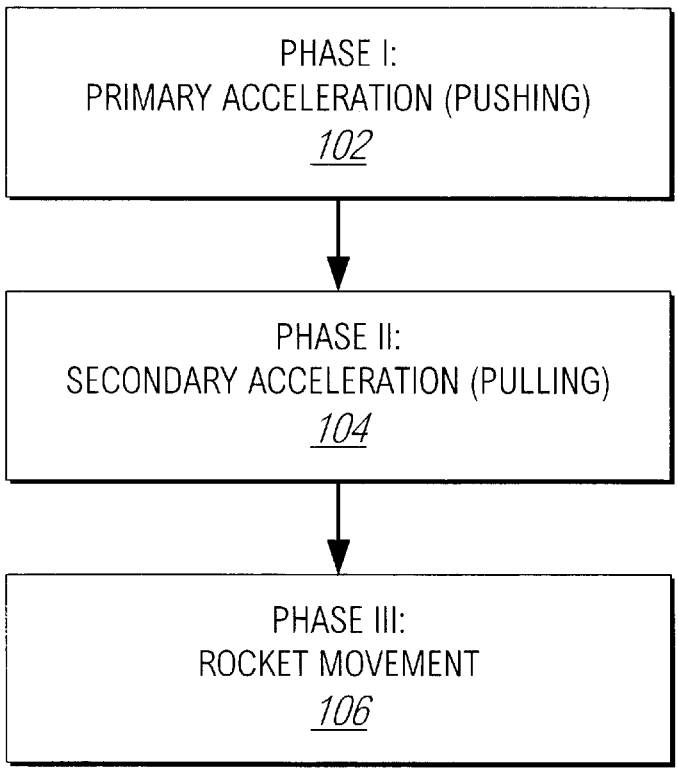
FIG. 1 is a flowchart illustrating the operation of a shooting system in accordance with the present invention.

Referring to FIG. 1, there is shown a flowchart illustrating the operation of a shooting system in accordance with the present invention. The method of shooting of the present invention includes three phases. The first phase is a primary acceleration phase, during which the pressure of expanding gases pushes a first accelerated part of a missile-rocket with respect to a second accelerated part of the missile-rocket and with respect to a support. The second phase is a secondary acceleration phase, during which the second accelerated part is pulled by the first accelerated part after the first accelerated part engages the second accelerated part. The movement of the first accelerated part forms a chamber that contains the expanding gases under pressure. The third phase is a rocket movement of the missile-rocket due to the energy of gases outflowing from the formed chamber through openings in the missile-rocket. Depending on which part of the missile-rocket is subjected to the primary acceleration, and which one to the secondary acceleration, the method has two main variants. The first main variant of the method of FIG. 1 is described. Here the first accelerated part is a core. The second accelerated part is a shell.

Figure 2A:
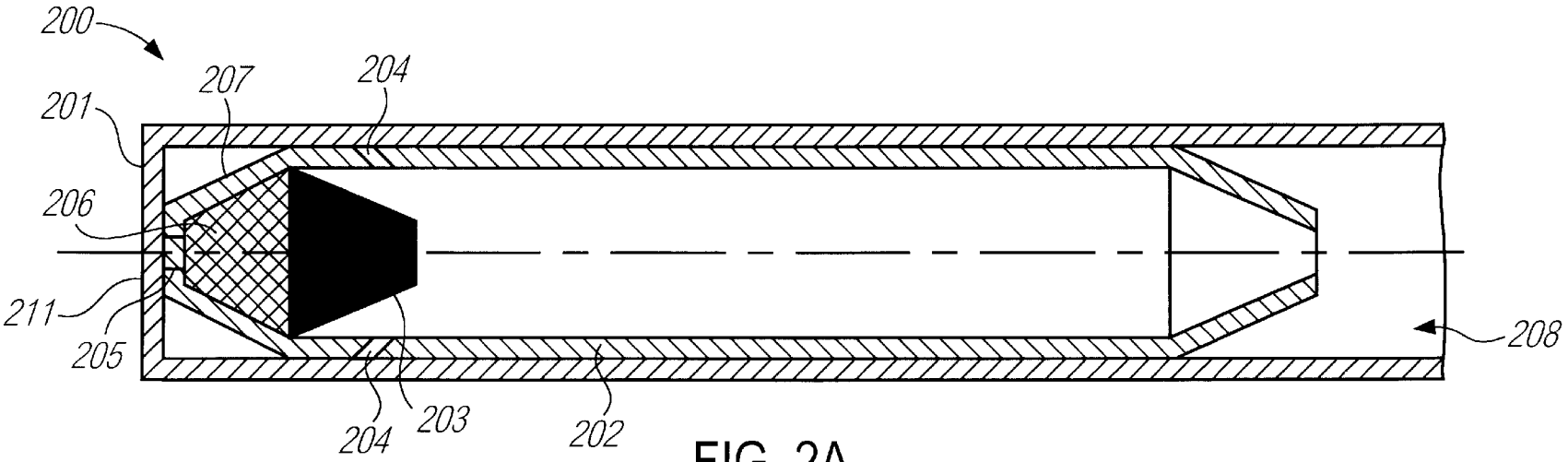
FIGS. 2*a* and 2*b* are partial longitudinal cross sectional views of an initial loaded state and a shooting state after the core engages the shell, respectively, in a shooting system with a movable core in accordance with a first embodiment of the invention.
Figure 2B:
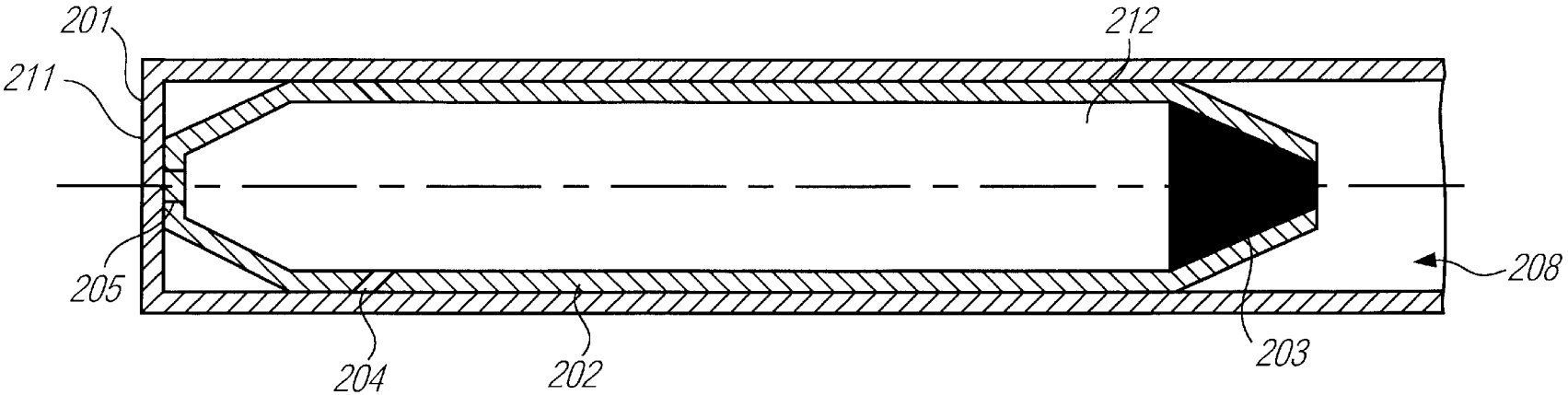

Referring to FIGS. 2*a* and 2*b*, there are shown longitudinal cross sectional views of an initial loaded state and a shooting state after the core engages the shell, respectively, of a shooting system 200, which includes a launcher 201 and a missile-rocket 207 that includes a movable core 203. The missile-rocket 207 includes a shell 202, the core 203, a plurality of openings 204, an activator 205, and a propellant 206.

Referring again to FIG. 1, during a primary acceleration phase, the core 203, which is a part of the missile-rocket 207, is accelerated 102 by the pressure of gases generated by the propellant 206. During the prime acceleration, the pressure of the gas pushes the core 203. During a secondary acceleration phase, the shell 202 of the missile-rocket 207 is accelerated 104 by the core 203 using the prime energy of the core 203. During the secondary acceleration, the core 203 pulls the shell 202. During a third phase, the missile-rocket 207 is moved 106 by reactive movement from the outflow of gases from the openings 204 of the shell 202.

Referring now to FIGS. 2*a*–2*b*, the launcher 201 has a constant uniform transverse cross-section, which is preferably circular. The launcher 201 may provide support for the projectile 207 or may provide directional guidance for the projectile 207. The launcher 201 includes a bore 208 disposed along a longitudinal axis of the launcher 201. A front end of the launcher 201 forms an opening 210. The launcher 201 includes a wall 211 on a rear end of the bore 208. The launcher 201 may be formed of a rigid material, such as metal or a rigid plastic. Alternatively, the launcher 201 may be merely guide rails, and not include a barrel.

The launcher 201 functions differently than a barrel in a conventional firearm that uses cartridges with explosives. In such a firearm, the barrel not only provides direction and stabilization to the bullet but also restrains the high pressure of the gas from the explosive. Here the launcher 201 supports the missile-rocket 207 at the initial stage of shooting, and also provides direction to the missile-rocket 207. The launcher 201 does not restrain the pressure of gases. Hence, the launcher 201 may be lighter in weight than a conventional firearm.

The shell 202 is tubular and has a substantially constant uniform transverse cross-section, which is preferably circular. The ends of the shell 202 may be tapered to smaller diameters so that the core 203 engages the shell 202 over a larger area than a nontapered shell 202. The plurality of openings 204 are disposed in the walls or the rear end of the shell 202. The openings 204 may be temporarily sealed when the missile-rocket 207 is in the first and second acceleration phases. Such seals may be thin walls in the shell 202 that cover the openings 204. Pressure from the expanding gases during the second phase break the seal to thereby allow gases to exhaust. The launcher 201 may seal the openings 204 until the openings 204 are outside the launcher 201 as the missile-rocket 207 moves forward and out of the launcher 201.

The core 203 is mounted in the bore of the shell 202 near the rear end of the shell 202. The core 203 is movable within the bore. The core 203 engages an inner wall of the shell 202 preferably to form a seal to substantially prevent the flow of gas from one side of the core 203 to another side of the core 203 through a windage between the inner wall of the shell 202 and the core 203.

The propellant 206 is disposed on the inner wall at the rear end of the shell 202. Alternatively, the propellant 206 may be disposed adjacent to the core 203. The propellant 206 may be, for example, a chemical source, such as an explosive, e.g., gunpowder. The propellant 206 generates a gas typically by an explosion.

The activator 205 is disposed on the rear end of the shell 202. The activator 205 couples to an activating system (not shown for simplicity), which enables the activator 205. The activator 205 ignites the propellant 206 to release gas into a chamber 212 formed by the shell 202 and the core 203 as the core 203 moves in the shell 202.

Referring again to FIG. 1, the operation of the shooting system 200 is again described in more detail. The missile-rocket 207 is placed into the bore 208 of the launcher 201 with the core 203, the activator 205, and the propellant 206 of the missile-rocket 207 being positioned adjacent the rear end of the launcher 201. The shooting system 200 is now initialized for firing.

During the primary acceleration phase, the activator 205 activates the propellant 206 to apply a force to the core 203 by an expanding gas created by exploding the propellant 206.

As the gas explodes, the force from the pressurized gas in the chamber 212 pushes and accelerates the core 203 until the core 203 engages the front inner tapered wall of the shell 202. At this time, the core 203 has a linear momentum L defined by:

$$L=m_c\times v_1 \quad (1),$$

where $m_c$ is the mass of the core 203, and $v_1$ is the velocity of the core 203 immediately prior to engaging the front inner wall of the shell 202.

When the core 203 engages the front end of the shell 202, the secondary acceleration phase begins, during which the shell 202 is accelerated 104 by the core 203 using the prime energy of the core 203 to pull both the core 203 and the shell 202. Both the core 203 and the shell 202 are accelerated, and thus the total mass that is being accelerated increases. Because of the law of conservation of linear momentum, the linear momentum of the missile-rocket 203 before and after the core 207 engages the front end of the shell 202 are equal and are defined by:

$$L=m_c\times v_1=(m_c+m_s)\times v_2 \quad (2)$$

where $m_c$ and $v_1$ are defined above in conjunction with equation (1), $m_s$ is the mass of the shell 202, and $v_2$ is the velocity of the missile-rocket 207 immediately after the core 203 engages the front inner wall of the shell 202. In this embodiment, the mass mc of the core 203 preferably is greater than the mass ms of the shell 202.

At the end of the second phase, the core 203 and the shell 202 form a closed chamber 212 in the shell 202, except for the openings 204 in the shell 202 that provide outflowing of gases from the closed chamber 212 for reactively accelerating the missile-rocket 207 during the third phase of acceleration. As the missile-rocket 207 exits the launcher 201, the openings 204 disengage the launcher 201 to thereby allow gas to exhaust the shell 202 through the openings 204.

During the third phase, the missile-rocket 207 is moved 106 by reactive movement from the outflow of gases from the openings 204 of the shell 202.

The volume on the side of the core 203 opposite the chamber 212 may contain a gas, such as air. As the core 203 moves in the bore of the shell 202, this gas may compress and thereby cushion the engagement of the core 203 and the shell 202. Alternatively, the shell 202 may contain an opening (not shown) to allow this gas to exhaust the shell 202.

The second main variant of the method of FIG. 1 is described. Here the first accelerated part is a shell. The second accelerated part is the core.

Figure 3A:
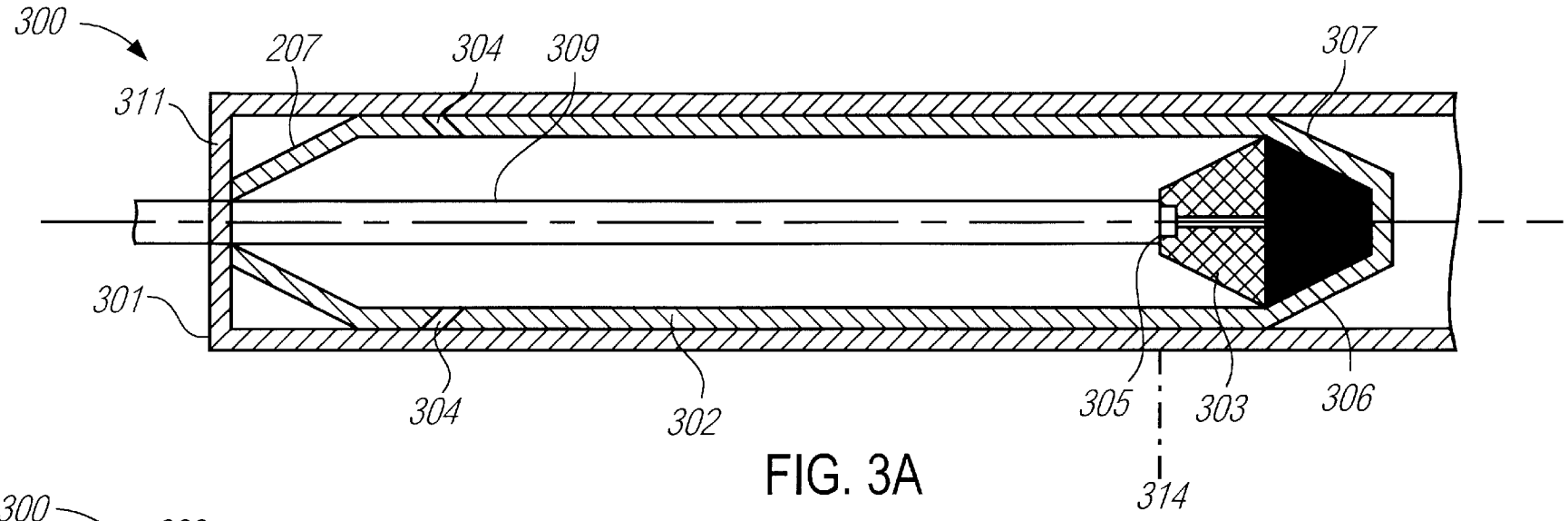
FIGS. 3*a* and 3*b* are partial longitudinal cross sectional views illustrating an initial loaded state and a shooting state after the shell engages the core, respectively, of a shooting system with a movable shell in accordance with a second embodiment of the present invention.
Figure 3B:
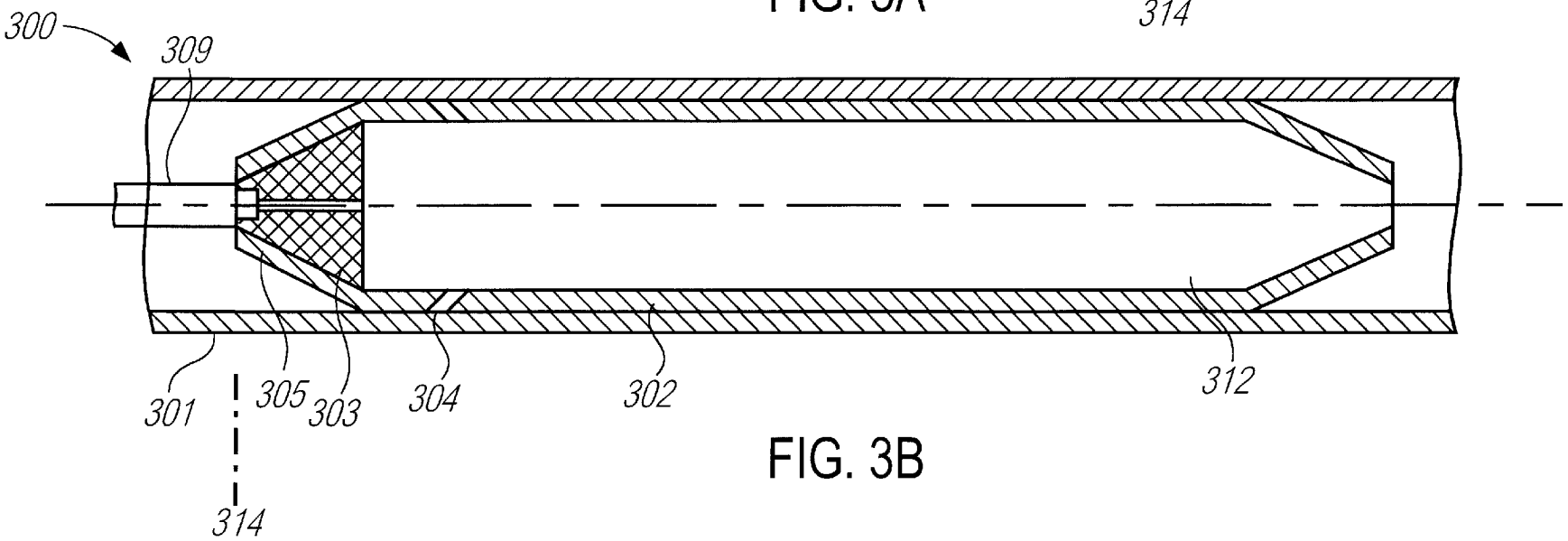
Figures 5A, 5B, 5C:
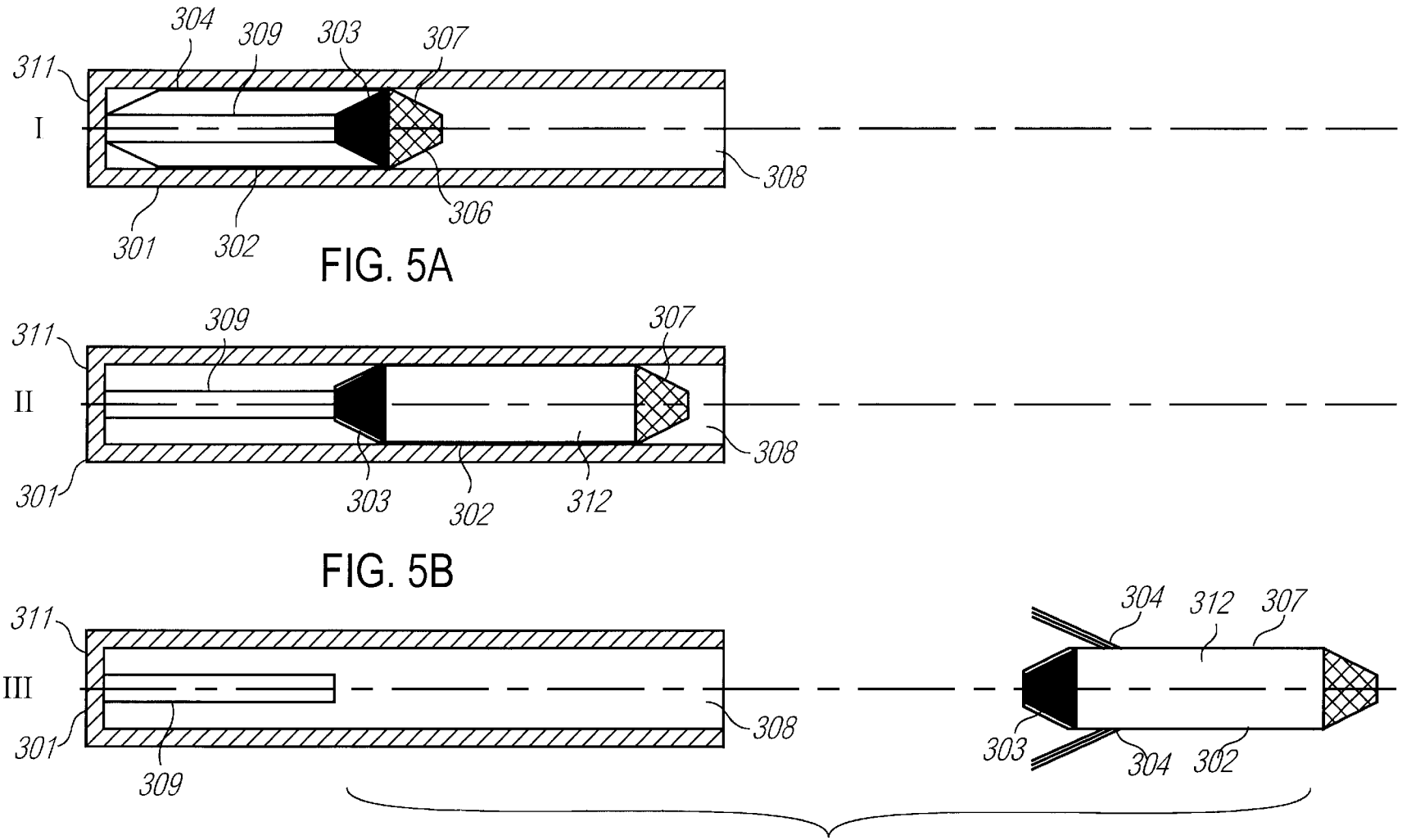
FIGS. 5*a* and 5*b* are longitudinal cross sectional views of the shooting system of FIGS. 3*a* and 3*b*, respectively.
FIG. 5*c* is a longitudinal cross sectional view of the shooting system of FIGS. 3*a* and 3*b* after the missile-rocket disengages the launcher.

Referring to FIGS. 3*a* and 3*b*, there are shown partial longitudinal cross sectional views of an initial loaded state and a shooting state after the shell engages the core, respectively, of a shooting system 300, which includes a launcher 301 and a missile-rocket 307 that includes a movable shell 302, in accordance with a second embodiment of the invention. The view of FIGS. 3*a* and 3*b* are translated relative to each other. A broken reference line 314 perpendicular to the longitudinal axis of the missile-rocket 307 provides a common reference point between the views of FIG. 3*a* and 3*b*. Referring to FIGS. 5*a* and 5*b*, there are shown longitudinal cross sectional views of the shooting system of FIGS. 3*a* and 3*b* respectively. Referring to FIG. 5*c*, there is shown a longitudinal cross sectional view of the shooting system 300 after the missile-rocket 307 disengages the launcher 301. A missile-rocket 307 includes the shell 302, a core 303, a plurality of openings 304, an activator 305, and a propellant 306.

The launcher 301 is tubular and has a constant uniform transverse cross-section, which is preferably circular. The launcher 301 includes a bore 308 disposed along a longitudinal axis of the launcher 301. A front end of the launcher 301 forms an opening 310. The launcher 301 includes a wall 311 on a rear end of the bore 308. The launcher 301 may be formed of a rigid material, such as metal or a rigid plastic. Alternatively, the launcher 301 may be merely guide rails, and not include a barrel. A support 309 may be used as such a guide rail.

The shell 302 may be similar in shape to the shell 202. The ends of the shell 302 may be tapered to smaller diameters for engaging the core 303 over a larger area than a nontapered shell 302. The plurality of openings 304 are disposed in the walls or the rear end of the shell 302.

The core 303 is disposed initially in the bore of the shell 302 near the front end of the shell 302, and is movable within the bore. The core 303 engages an inner wall of the shell 302 preferably to form a seal to substantially prevent the flow of gas from one side of the core 303 to another side of the core 303 through a windage between the inner surface of the shell 302 and the core 303.

The propellant 306 is disposed on the inner wall at the front of the shell 302. Alternatively, the propellant 306 may be disposed on the core 303. The propellant 306 generates a gas typically by an explosion. The propellant 306 may be similar to the propellant 206.

The activator 305 is disposed on a rear end of the core 303 to ignite the propellant 306. The support 309 is mounted to the rear inner wall of the launcher 301. The support 309 extends outwardly from the rear end of the launcher 301 in the bore of the launcher 301.

The activator 305 couples to an activating system (not shown for simplicity), which enables the activator 305. The activator 305 ignites the propellant 306 to release gas into a chamber 312 between the core 303 and the shell 302 formed as the shell 302 moves with respect to the core 303 in response to the expanding gas. The propellant 306 may be similar to the propellant 206. The propellant 306 is disposed between the core 303 and the front end of the shell 302.

Referring again to FIG. 1, the operation of the shooting system 300 in the second embodiment of the method is again described in more detail. The missile-rocket 307 is placed into the bore 308 of the launcher 301 with the core 303 and the propellant 306 positioned near the front end of the shell 302. Alternatively, in the system 300 in which the support 309 functions as a launcher, the missile-rocket 307 is placed on the support 309. The shooting system 300 is now initialized for firing. During the primary acceleration phase, the activator 305 activates the propellant 306 to explode and create a gas that expands in the chamber formed by the shell 302 and the core 303 to thereby apply a force to the front end of the shell 302.

As the gas expands, the force from the pressurized gas pushes the shell 302 to urge the front end of the shell 302, to accelerate the shell 302 until the rear portion of the inner wall of the shell 302 engages the rear end of the core 303. At this time, the shell 302 has a linear momentum L defined by:

$$L=m_s\times v_1 \quad (3),$$

where $m_s$ is the mass of the shell 302, and $v_1$ is the velocity of the shell 302 immediately prior to engaging the rear end of the core 303.

When the shell 302 engages the rear end of the core 303, the secondary acceleration phase begins, in which the shell 302 accelerates 104 the core 303 using the prime energy of the shell 302 to pull both the core 303 and the shell 302. Both the core 303 and the shell 302 are accelerated, and thus the total mass that is being accelerated increases. Because of the law of conservation of linear momentum, the linear momentum of the missile-rocket 307 before and after the shell 302 engages the rear end of the core 303 are equal and are defined by:

$$L=m_s\times v_1=(m_c+m_s)\times v_2 \quad (4)$$

where $m_s$ and $v_1$ are defined above in conjunction with equation (3), $m_c$ is the mass of the core 303, and $v_2$ is the velocity of the missile-rocket 307 immediately after the shell 302 engages the rear end of the core 303. For this embodiment, the mass mc of the core 303 preferably is less than the mass ms of the shell 302. Because the total mass that is being accelerated increases, the acceleration is less during the second phase.

During the third phase, the missile-rocket 307 is moved 106 by reactive movement from the outflow of gases from the chamber 312 through the openings 304 in the shell 303. Alternatively, at the end of the second phase, the engagement of the rear end of the shell and the core forms the opening in the rear end of the shell.

The volume on the side of the core 303 opposite the chamber 312 may contain a gas, such as air. As the core 303 moves in the bore of the shell 302, this gas may compress and thereby cushion the engagement of the core 303 and the shell 302. Alternatively, the shell 302 may contain an opening to allow this gas to exhaust the shell 302.

The method and shooting system provides a missile-rocket 307 that has high acceleration. Because the missile-rocket includes both the shell 302 and the core 303, as well as the ignited propellant, the missile-rocket carries substantially all of its original material during its flight. Similarly, the system does not require extracting a spent case as is required in firearms using a barrel. Instead, the system uses simple kinematics. In addition, because the ignition of the propellant is contained in the missile-rocket, practically no energy is lost through the sound of a report. Essentially all energy of the propellant is used for accelerating the projectile 307, initially by the action of gas pressure, and later by outflowing gases from the openings 304. Another benefit of such an essentially complete energy usage is the ability to perform the shooting practically without sound and to eliminate problems of overheating of the launching device.

The missile-rocket 307 includes the functions of various components of a conventional firearm. For example, the missile-rocket restrains the pressure of gases in a manner similar to a barrel in the conventional firearm. Further, the missile-rocket functions as the projectile to strike a target in a manner similar to a bullet in the conventional firearm. In addition, the missile-rocket controls the gas to flow out slowly from the shell 302 without sharp sounds in a manner similar to a silencer. The missile-rocket also transfers essentially all energy from the launcher 301, and thus eliminates the cooling required in a conventional firearm.

Figure 4:
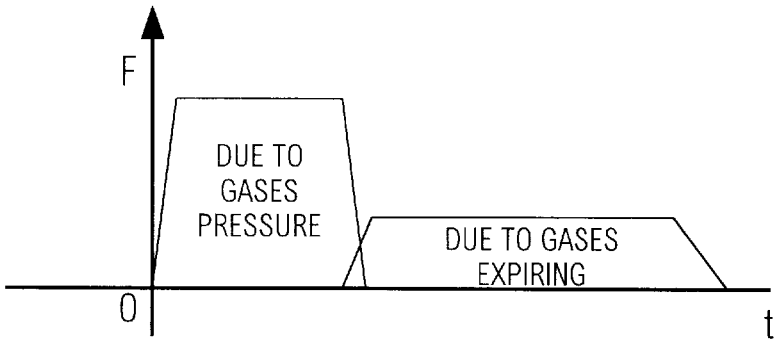
FIG. 4 is a graph illustrating the time dependent force acting on the missile-rocket for the acceleration phases of the method of FIG. 1.

Referring to FIG. 4, there is shown a graph illustrating the time dependent force acting on the missile-rocket for the acceleration phases of the method of FIG. 1. During the first phase, the ignition of the propellant applies a force to the first movable part of the missile-rocket. The first movable part of the missile-rocket 207 is the core 203. The first movable part of the missile-rocket 307 is the shell 302. During the second phase, the first movable part of the missile-rocket engages the second movable part and the entire missile-rocket accelerates. During the third phase, the gases exhausting from the missile-rocket provide the reactive force to the missile-rocket. The force on the missile-rocket from the first phase is greater than the force on the missile-rocket in the third phase. Thus, the first phase provides greater acceleration to the missile-rocket.

Figures 6A, 6B, 6C:
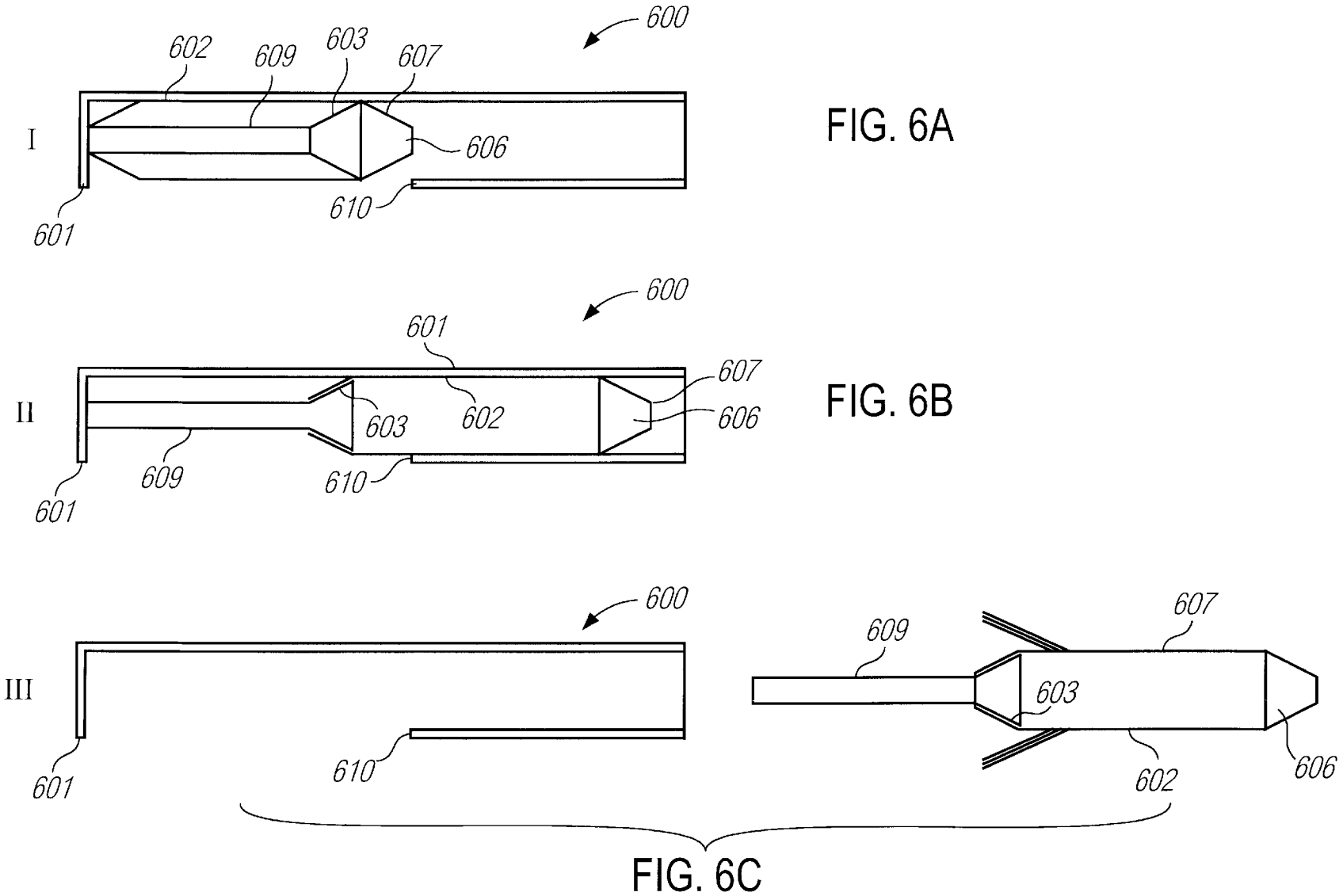
FIGS. 6*a*, 6*b*, and 6*c* are longitudinal cross-sectional views illustrating an initial loaded state, a shooting state after the shell engages the core, and a shooting state after the missile-rocket disengages the launcher, respectively, of a shooting system in a third embodiment of the present invention.

Referring to FIGS. 6*a*, 6*b*, and 6*c*, there are shown longitudinal cross-sectional views illustrating an initial loaded state, a shooting state after the shell engages the core, and a shooting state after the missile-rocket disengages the launcher, respectively, of a shooting system 600 in a third embodiment of the present invention. The shooting system 600 is similar to the shooting system 300, described above in conjunction with FIGS. 3 and 5. The shooting system 600 includes a launcher 601 and a missile-rocket 607. The launcher 601 has an opening 610 in a sidewall to allow the missile-rocket 607 to be inserted therein. The missile-rocket 607 includes a shell 602, a core 603, a propellant 606, and a support 609. The core 603 is disposed on the front end of the support 609, which is integral with the core 603, and moves within the center of the shell 602 after the first phase of acceleration is completed. The propellant 606 is disposed on the front end of the shell 602. The propellant 606 may be similar to the propellant 306 discussed above in conjunction with FIG. 3. The support 609 is preferably formed to be light weight, and with a small cross section. The support 609 may be, for example, hollow or containing thin ribs. For simplicity, no activator is shown in FIGS. 6*a*, 6*b*, and 6*c*. However, an activator such as the activator 305 may be included in the missile-rocket 607. The system 600 operates in a manner similar to that of the system 300 described above. However, in the system 600, the support 609 remains integral with the missile-rocket 607 after disengaging the launcher 601.

Such a shooting system 600 allows most of the system 600 to move away from the shooter. Reloading such a system is easier because the missile-rocket need not be aligned with the support. For example, such a system may be reloaded in an automatic mode by inserting the missile-rocket through the opening 610 into the bore of the launcher 601. The launcher may be reloaded as soon as the missile-rocket 607 in the launcher 601 has been activated and has moved sufficiently to allow the next missile-rocket 607 to be inserted therein. This does not require the movement of a slide, the ejection of a spent case, and the movement back of a slide as in a conventional firearm.

Figure 7A:
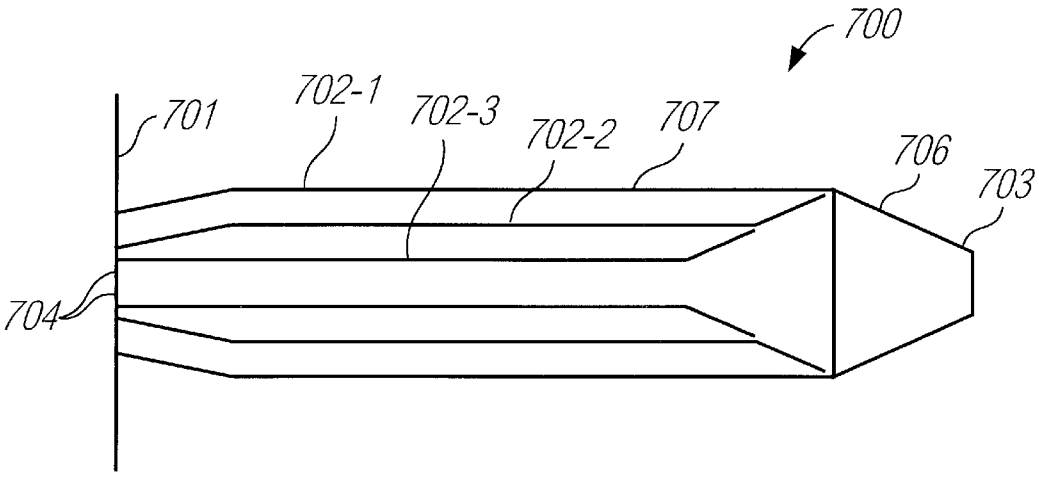
FIGS. 7*a* and 7*b* are longitudinal cross-sectional views illustrating an initial loaded and a shooting state, respectively, of a multi-stage shooting system in accordance with a fourth embodiment of the present invention.
Figure 7B:
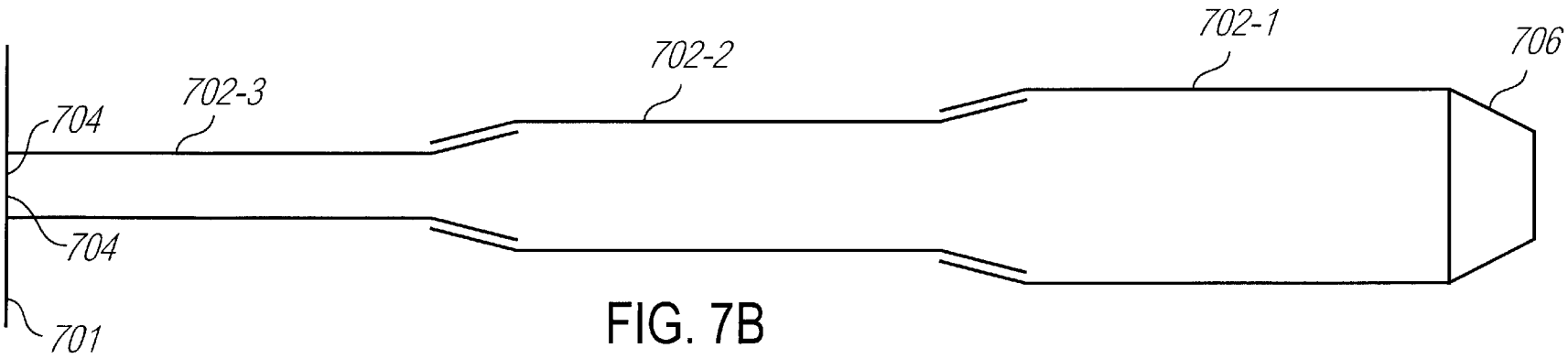

FIGS. 7*a* and 7*b* are longitudinal cross-sectional views illustrating an initial loaded state and a shooting state, respectively, of a multi-stage shooting system 700 in accordance with a fourth embodiment of the present invention. A missile-rocket 707 includes shell sections 702-1 through 702-3, a core 703, and a propellant 706. The shell section 702-3 is disposed in the shell section 702-2, which is disposed in the shell section 702-1. Each shell section 702 has a tubular shape and a substantially constant uniform cross-section over a large part of the shell section 702. The rear ends of the shell sections 702-1 and 702-2 are tapered inwardly. The front end of the shell sections 702-2 and 702-3 are tapered outwardly. The core 703 is disposed on the front end of the shell section 702-1. The propellant 706 is disposed on the rear end of the core 703. After the propellant 706 is activated, the expanding gases fill a chamber in the shell section 702-3, which urges the shell section 702-1 outward from a support 701. The shells 702-1 , 2 and 3 are filled with the expanding gases until the tapered rear end of the shell 702-1 engages the tapered front end of the shell 702-1. The pressure of the gases pushes the core 703 forward to extend the shell 702-1. As the shell 702-1 moves from the support 701, the tapered rear end of the shell 702-1 engages the tapered front end of the shell 702-2. The shell sections 702-1, -2 and -3 are urged outward until the shells are fully extended as shown in FIG. 7*b*. The shell 702 then disengages the support 701. The gases exhaust from openings 704 in the rear end of the shell 702-3 to provide reactive acceleration and movement of the missile-rocket 707. The multistage system uses more of the energy of the activation of the propellant for the acceleration in the first phase, which has high acceleration rates, and thus has a higher initial velocity at the end of the second phase.

Although the shell 702 is described with three sections, the shell 702 may have two or more sections.

Three embodiments having an expandable shell that is integral with the core are now described.

Figures 8A, 8B, 8C:
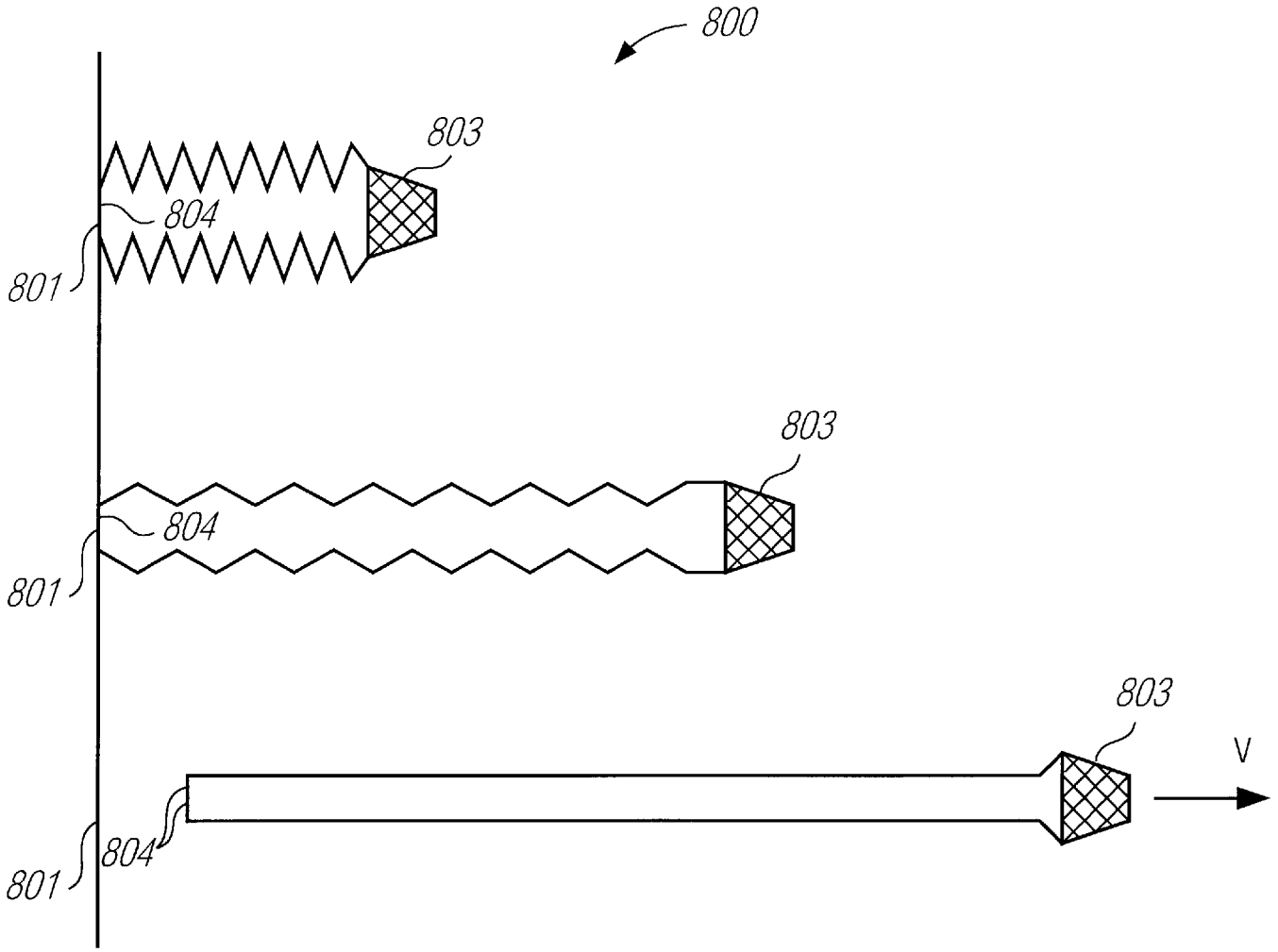
FIGS. 8*a*, 8*b*, and 8*c* are longitudinal cross sectional views of a shooting system in an initial loaded state, an intermediate shooting state after activation of the propellant, and a shooting state after the missile-rocket disengages the support, respectively, in accordance with a fifth embodiment of the present invention.

Referring to FIGS. 8*a*, 8*b*, and 8*c*, there are shown longitudinal cross sectional views of a shooting system 800 in an initial loaded state, a first shooting state after activation of the propellant, and a shooting state after the missile-rocket disengages the support, respectively, in accordance with a fifth embodiment of the present invention. The missile-rocket 807 includes a gofferred shell 802, preferably formed of metal, and includes a core 803 integral with the front end of the shell 802. The core 803 preferably has a mass substantially greater than the mass of the shell 802. The missile-rocket 807 also includes a propellant (not shown), preferably formed of a chemical. The propellant may be disposed, for example, on the core 803 or the shell 802. The missile-rocket 807 is detachably mounted to a support 801. Openings 804 in the rear end of the shell 802 are blocked by the support 801 to contain gas in the shell 802 until the shell 802 disengages the support 801. After ignition, the expanding gases cause the shell 802 to fully expand. After such expansion, the missile-rocket 807 disengages from the support 801 and further motion of the missile-rocket 807 is due to exhausting gases through the openings 804.

Figures 9A, 9B, 9C:
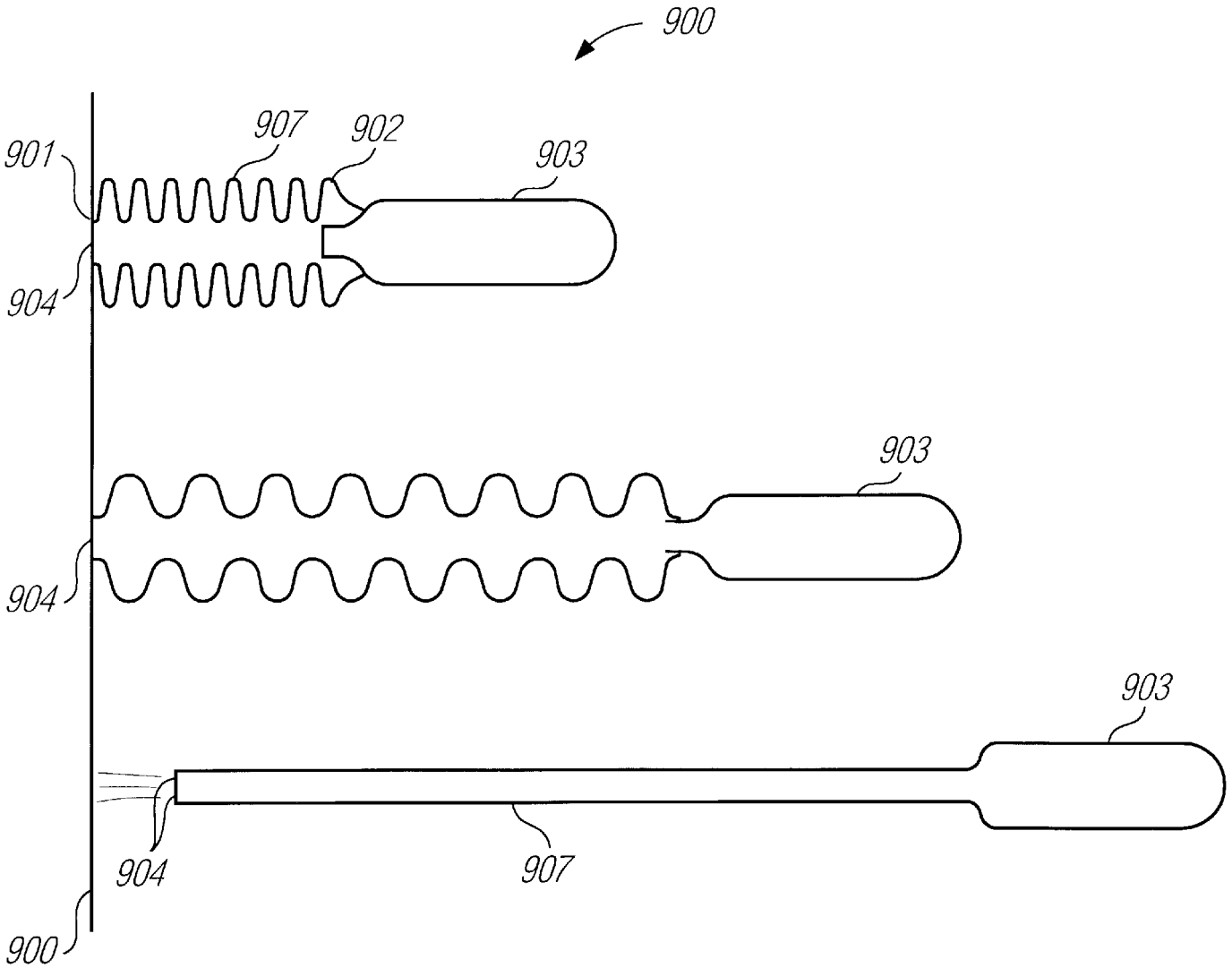
FIG. 9*a*, 9*b*, and 9*c* are longitudinal cross sectional views of a shooting system in an initial loaded state, an intermediate shooting state after activation of the gas propellant, and a shooting state after the missile-rocket disengages the support, respectively, in accordance with a sixth embodiment of the present invention.

Referring to FIG. 9*a*, 9*b*, and 9*c*, there are shown longitudinal cross sectional views of a shooting system 900 in an initial loaded state, a shooting state after activation of a gas propellant, and a shooting state after the missile-rocket disengages the support, respectively, in accordance with a sixth embodiment of the present invention. The missile-rocket 907 includes a gofferred shell 902, preferably formed of an elastic material, and includes a core 903 integral with the shell 902. The core 903 preferably is formed as a gas filled cartridge containing a compressible gas propellant. The missile-rocket 907 is detachably mounted to a support 901. Openings 904 in the rear end of the shell 902 are blocked by the support 901 to contain gas in the shell 902 until the shell 902 disengages the support 901. The support 901 may be, for example, the hand of an operator of the system 900.

After activation of the propellant, such as opening a valve to release gas from the cartridge in the core 903, the expanding gas causes the shell 902 to fully expand as shown in FIG. 9*b*. After such expansion, the shell 902 disengages the support 901 and further motion of the missile-rocket 907 is due to gas exhausting from the openings 904 in the rear end of the gofferred shell 902 as shown in FIG. 9*c*.

In addition to general feature of the present invention of shooting without sound, the embodiments of FIGS. 8 and 9 do not require a special launcher, and hence do not leave any trace at the place of shooting.

Figures 10A, 10B, 10C:
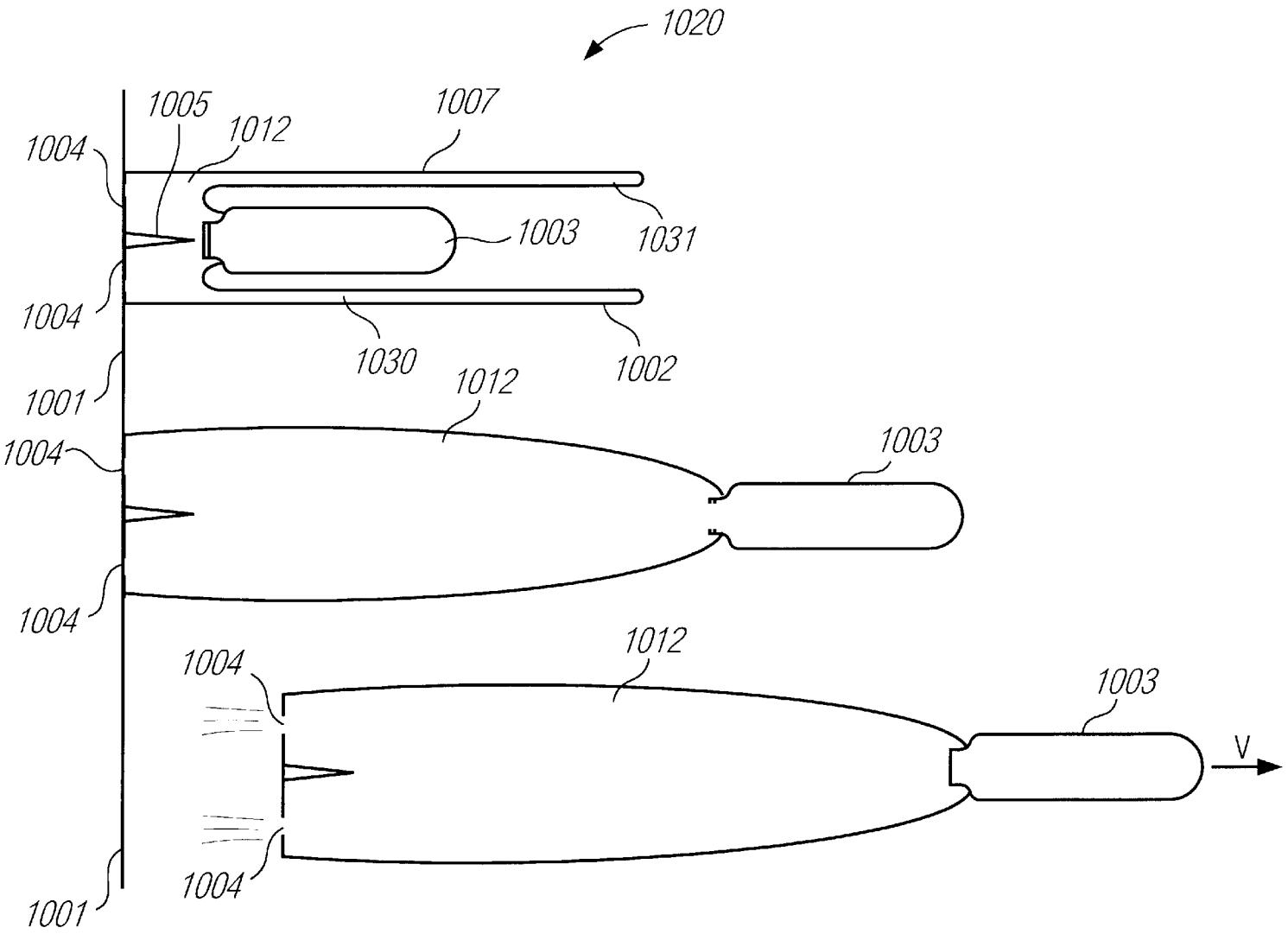
FIGS. 10*a*, 10*b*, and 10*c* are longitudinal cross-sectional views illustrating an initial loaded state, an intermediate shooting state after activation of a gas propellant, a shooting state after the missile-rocket disengages the support, respectively, of a shooting system in a seventh embodiment of the present invention.

Referring to FIGS. 10*a*, 10*b*, and 10*c*, there are shown longitudinal cross-sectional views illustrating a loaded state, a shooting state after the activation of a gas propellant and a shooting state after the missile-rocket disengages the support, respectively, of a shooting system 1000 in a seventh embodiment of the present invention. The shooting system 1000 includes a launcher 1001 and a missile-rocket 1007. For lower accelerations, the launcher 1001 for the missile-rocket 1007 may be the hand of an operator of the system 1000.

The missile-rocket 1007 includes a shell 1002, a core 1003, and an activator 1005. The shell 1002 includes a semi-rigid portion 1030 and a flexible portion 1031 having a first end mounted to a front end of the semi-rigid portion 1030. The semi-rigid portion 1030 and the flexible portion 1031 may be formed of the same material and the rigidity or flexibility of such portions may be determined by the thickness of the wall of the portions, by the addition of ribs, or the like. The rear part of the shell 1002 may be crimped in a manner similar to that of the system 600 or 700 of FIGS. 6 and 7, respectively. The flexible portion 1031 initially is in a bore of the semi-rigid portion 1030.

The core 1003 is integrally coupled to a second end of the flexible portion 1031 with a valve of the core 1003 positioned near the activator 1005 for engaging the activator 1005. The core 1003 includes a compressible fluid, such as gas. The core 1003 is mounted to the second end of the flexible portion 1031 of the shell 1002 to substantially contain the released fluid in a chamber 1012 until the missile-rocket 1007 disengages from the launcher 1001. After the valve is opened, the expanding gas urges the core 1003 along the longitudinal axis of the shell 1002 to pull and fully extend the flexible portion 1031 as shown in FIG. 10*b*. Referring now to FIG. 10*c*, after the missile-rocket 1007 disengages from the launcher 1001, the motion of the missile-rocket 1007 is due to exhausting gas from the openings 1004 on the rear end of the semi-rigid portion 1030.

The shooting systems 800, 900, and 1000 are relatively simpler embodiments and have a smooth transition between the first and second accelerating phases.

The shooting systems 200, 300, 600, 700, and 800 are described above with the propellant exhausting its activation or burn during the first and second accelerations phases. However, the propellant may continue to burn during the third acceleration phase to provide further gas for the reactive acceleration. This provides a longer rocket phase, and thus its part in the overall process of accelerating the missile-rocket is more significant.

The shooting systems 200, 300, 600, and 700 may be mounted to a stock, as in a conventional rifle, or to a pistol grip. The activators may be coupled to a conventional trigger.

The flight of the missile-rocket may be stabilized by a gyroscopic effect by rotating of the core along rifling along the surface of the bore of the shell. The missile-rocket may be stabilized by tangential outflowing of gases from openings in the shell. Alternatively, mechanical stabilizers, such as stabilizing fins, may be mounted on the rear part of the shell. Such fins may open after the shell exits the launcher. Alternatively, the stabilizing fins can be placed on the outlet of the launcher and moved from the launcher by the projectile after exiting the bore.

The present invention provides new methods and devices for shooting. Because of its positive features, such as the essentially complete use of material and energy, reduction of noise, the simplicity of the launcher, and the practical elimination of the problem of overheating, the shooting system of the present invention may replace most of the present shooting systems that use an old paradigm. Such systems may include large and small firearms, such as cannons, throwers, and general and special purpose guns.

The shooting system provides a light weight weapon because most of the mass is in the ammunition, namely the missile-rocket. The system may be operated in either an automatic, semi-automatic, or manual mode. The automatic and semi-automatic modes provide high rates of firing. The system is practically silent because the explosion is contained in the shell and the resultant gases are controllably released from the shell. The system has less recoil then a conventional firearm.

The kinematics of the system of the present invention is simpler then the kinematics of a conventional firearm. The system of the present invention does not require extracting a case, removing gas, or expelling heat. A system of the present invention provides a weapon that is carried away after firing as the projectile and leaves little trace of the shooting at the place of the shooting.

I claim:

1. A method of shooting a missile-rocket having inner and outer parts one of which is movable relative to the other in a primary acceleration phase and both of which are movable together in a secondary acceleration phase and in a subsequent rocket phase, the inner and outer parts forming a chamber therebetween containing a propellant, wherein there is a launching device for the missile-rocket, comprising:

igniting the propellant in the primary acceleration phase thereby creating gas pressure in the chamber to move one of the parts in a predetermined direction relative to the other part and into engagement therewith, thereby to initiate the secondary acceleration phase wherein the gas pressure in the chamber causes the one part to move the other part in said predetermined direction;

maintaining said other part immobile relative to the launching device during the primary acceleration phase;

blocking escape of gas from the chamber during the primary and secondary acceleration phases whereby substantially all of the energy of the gas pressure in the chamber is used to accelerate first the one part and then both of the parts respectively in the primary and secondary acceleration phases; and enabling gas to escape from the chamber following the secondary acceleration phase thereby to initiate the rocket phase and provide reactive forces to sustain propulsion of the missile-rocket in said predetermined direction.

2. The method of claim 1, wherein the igniting step causes the inner part to be propelled in said predetermined direction in the primary acceleration step; and wherein said maintaining step maintains the outer part immobile relative to the launching device during the primary acceleration phase.

3. The method of claim 1, wherein the igniting step causes the outer part to be propelled in said predetermined direction; and wherein said maintaining step maintains the inner part immobile relative to the launching device during the primary acceleration phase.

4. The method of claim 1, wherein the missile-rocket has forward and rearward portions, said predetermined direction is forward, and the chamber is formed rearwardly of the inner part, wherein the igniting step involves igniting the propellant in the primary acceleration phase to cause the inner part to be propelled forwardly.

5. The method of claim 1, wherein the missile-rocket has forward and rearward portions, said predetermined direction is forward, and the chamber is formed forwardly of the inner part, wherein the igniting step involves igniting the propellant in the primary acceleration phase to cause the outer part to be propelled forwardly.

6. The method of claim 1, wherein the igniting step involves propelling the inner part in said predetermined direction relative to the launching device; and wherein said maintaining step maintains the outer part immobile relative to the launching device during the preliminary acceleration phase.

7. The method of claim 1, wherein the igniting step involves propelling the outer part in said predetermined direction relative to the launching device; and wherein said maintaining step involves maintaining the inner part immobile relative to launching device during the preliminary acceleration phase.

8. The method of claim 1 wherein the launching device includes a support integral with the inner part, wherein the igniting step involves propelling the outer part in said predetermined direction relative to the inner part and the support;

wherein said maintaining step involves maintaining the support and the inner part immobile relative to the launching device part during the preliminary acceleration phase; and wherein the enabling step causes the support, the inner part and the outer part to be propelled together in said predetermined direction in the rocket phase.

9. A shooting device, comprising:

a missile-rocket having inner and outer parts one of which is movable relative to the other in a primary acceleration phase and both of which are movable together in a secondary acceleration phase and in a subsequent rocket phase, the inner and outer parts forming a chamber therebetween;

a propellant in the chamber;

means for igniting the propellant in the primary acceleration phase thereby creating gas pressure in the chamber to move one of the parts in a predetermined direction relative to the other part and into engagement therewith, thereby to initiate the secondary acceleration phase wherein the gas pressure in the chamber causes the one part to move the other part in said predetermined direction;

means for launching the missile-rocket;

means for maintaining said other part immobile relative to said means for launching during the primary acceleration phase;

means for blocking escape of gas from the chamber during the primary and secondary acceleration phases whereby all of the energy of the gas pressure in the chamber is used to accelerate first the one part and then both of the parts respectively in the primary and secondary acceleration phases; and means for enabling gas to escape from the chamber following the secondary acceleration phase thereby to initiate the rocket phase and provide reactive forces to sustain propulsion of the missile-rocket in said predetermined direction.

10. The shooting device of claim 9, wherein igniting means causes the gas pressure to propel the inner part in said predetermined direction during the primary acceleration phase; and wherein said maintaining means maintains the outer part immobile relative to the means for launching during the primary acceleration phase.

11. The shooting device of claim 9, wherein the igniting means causes the gas pressure to propel the outer part in said predetermined direction during the primary acceleration phase; and wherein said maintaining means maintains the inner part immobile relative to the means for launching during the primary acceleration phase.

12. A shooting device, comprising:

a missile-rocket having inner and outer parts one of which is movable relative to the other in a primary acceleration phase and both of which are movable together in a secondary acceleration phase and in a subsequent rocket phase, the inner and outer parts forming a chamber therebetween;

a launching device for the missile-rocket;

a propellant in the chamber;

an activator for igniting the propellant in the primary acceleration phase thereby creating gas pressure in the chamber to move one of said parts in a predetermined direction relative to other of said parts and into engagement therewith, thereby to initiate the secondary acceleration phase wherein the gas pressure in the chamber causes said one part to move said other part in said predetermined direction;

said other part being immobile relative to the launching device during the primary acceleration phase, the chamber being closed during the primary and secondary acceleration phases thereby blocking escape of gas from the chamber, whereby all of the energy of the gas pressure in the chamber is used to accelerate first the one part and then both of said parts respectively in the primary and secondary acceleration phases, and the chamber being open at the end of the secondary acceleration phase thereby releasing gas from the chamber, whereby to initiate the rocket phase and provide reactive forces to sustain propulsion of the missile-rocket in said predetermined direction.

13. The shooting device of claim 12, wherein the missile-rocket has forward and rearward portions;

wherein said predetermined direction is forward;

wherein the chamber is formed rearwardly of the inner part; and wherein the outer part is immobile relative to the launching device during the primary acceleration phase.

14. The shooting device of claim 12, wherein the missile-rocket has forward and rearward portions;

wherein said predetermined direction is forward;

wherein the chamber is formed forwardly of the inner part; and wherein the inner part is immobile relative to the launching device during the primary acceleration phase.

15. The shooting device of claim 12, wherein the missile-rocket has forward and rearward portions;

wherein the outer and inner parts are respectively an elongated tubular shell and a core disposed in the shell so that either the core or the shell is slideable relative to the other part, said shell having a circumferential wall and opposite ends;

wherein the chamber is located between the core and one end of the shell; and wherein the core and the wall of the shell are in slideable, gas-tight engagement to prevent movement of gas from one side of the core to the other.

16. The shooting device of claim 15, wherein the chamber is between the rearward end of the shell and the core.

17. The shooting device of claim 15, wherein the chamber is between the forward end of the shell and the core.

18. The shooting device of claim 12, wherein the launching device also includes an elongated support;

wherein the outer part of the missile-rocket is an elongated tubular shell surrounding the support in the primary acceleration phase;

wherein the inner part of the missile-rocket is a core within the shell and in engagement with the support in the primary acceleration phase; and wherein the activator causes the shell to be moved in said predetermined direction relative to the support and the core in the primary acceleration phase.

19. The shooting device of claim 18, wherein the core is integral with the support; and wherein the shell, the core, and the support are propelled together in said predetermined direction in the rocket phase.

20. The shooting device of claim 18, wherein the support is a rod coaxial with the shell.

21. The shooting device of claim 12, wherein the outer part includes a plurality of telescopically interfitted sections.

22. The shooting device of claim 12, wherein the outer part is an elongated tubular shell having opposite ends one of which is internally frusto-conical;

wherein the inner part is a core in the shell and having opposite ends one of which is frusto-conical and facing the frusto-conical end of shell for interfitting engagement therewith; and wherein the activator causes said frusto-conical ends of the shell and core to come into said interfitting engagement at the initiation of the secondary acceleration phase.

23. The shooting device of claim 12, wherein the outer part is an elongated tubular shell having forward and rearward end portions;

wherein the inner part is a core movably mounted in the shell:

wherein the shell has a plurality of exhaust openings in the rearward portion thereof;

wherein the exhaust openings are temporarily sealed during the primary acceleration phase and at the initiation of the secondary acceleration phase and thereafter are unsealed during said secondary acceleration phase and in the rocket phase to allow gases in the chamber to escape; and wherein the core has a slideable sealing engagement with the shell.

24. The shooting device of claim 12, wherein mass of inner part exceeds the mass of the outer part.

25. The shooting device of claim 12, wherein mass of outer part exceeds the mass of the inner part.

26. The shooting device of claim 12, wherein inner part is solid.

27. The shooting device of claim 12, wherein inner part is hollow.

28. The shooting device of claim 12, wherein the inner part includes a core in the outer part and a rod integral with the core and extending in a direction opposite from said predetermined direction.

29. The shooting device of claim 28, wherein the core is hollow.

30. The shooting device of claim 12, wherein the outer part has an exhaust opening leading out of the chamber;

wherein the launching device seals the opening in the primary and secondary acceleration phases.

31. The shooting device of claim 12, wherein the outer part has an exhaust opening providing communication outwardly from the chamber; and wherein the inner and outer parts are in slideable gas-tight relation thereby providing a seal therebetween that prevents movement of gas past the seal.

* * * * *